US008618346B2

(12) United States Patent
Al Nashef et al.

(10) Patent No.: US 8,618,346 B2
(45) Date of Patent: Dec. 31, 2013

(54) PROCESS FOR THE DESTRUCTION OF SULFUR AND NITROGEN MUSTARDS AND THEIR HOMOLOGOUS/ANALOGOUS AT AMBIENT CONDITIONS

(75) Inventors: Inas Muen Al Nashef, Riyadh (SA); Saeed M. Al Zahrani, Riyadh (SA)

(73) Assignee: King Saud University, Riyadh (SA)

( * ) Notice: Subject to any disclaimer, the term of this patent is extended or adjusted under 35 U.S.C. 154(b) by 1292 days.

(21) Appl. No.: 12/078,001

(22) Filed: Mar. 26, 2008

(65) Prior Publication Data

US 2012/0149963 A1 Jun. 14, 2012

Related U.S. Application Data

(60) Provisional application No. 60/929,609, filed on Jul. 5, 2007.

(51) Int. Cl.

| | |
|---|---|
| ***A62D 3/115*** | (2007.01) |
| ***A62D 3/00*** | (2007.01) |
| ***A62D 3/30*** | (2007.01) |
| ***A62D 3/32*** | (2007.01) |

(52) U.S. Cl.

USPC ..... 588/302; 568/300; 568/313; 568/314; 568/401

(58) Field of Classification Search

USPC ..... 588/300, 301, 302, 303, 313, 314, 318, 588/319, 320, 400, 401

See application file for complete search history.

(56) References Cited

U.S. PATENT DOCUMENTS

| | | | | |
|---|---|---|---|---|
| 7,763,768 | B2 * | 7/2010 | Al Nashef et al. | 588/316 |
| 7,812,211 | B2 * | 10/2010 | Al Nashef et al. | 588/316 |
| 8,147,792 | B2 * | 4/2012 | Al Nashef et al. | 423/581 |
| 2004/0009095 | A1 * | 1/2004 | Giletto et al. | 422/28 |
| 2009/0008262 | A1 * | 1/2009 | Al Nashef et al. | 205/352 |
| 2009/0012345 | A1 * | 1/2009 | Al Nashef et al. | 588/316 |
| 2009/0012346 | A1 * | 1/2009 | Al Nashef et al. | 588/316 |

OTHER PUBLICATIONS

Welton, "Room-temperature ionic liquids. Solvents for synthesis and catalysis". Chem. Rev. 1999, 99, 2071-2083.*

Keskin et al., "A review of ionic liquids towards supercritical fluid applications". J. of Supercritical Fluids 43 (2007) 150-180.*

Wilkes, "A short history of ionic liquids-from molten salts to neoteric solvent". Green Chemistry, 2002, 4, 73-80.*

Eslamimanesh et al. "Artificial neural network modeling of solubility of supercritical carbon dioxide in 24 commonly used ionic liquids". Chemical Engineering Science 66 (2011) 3039-3044.*

(Continued)

*Primary Examiner* — Kaj K. Olsen
*Assistant Examiner* — Jennifer Smith
(74) *Attorney, Agent, or Firm* — Hart IP Law & Strategies

(57) ABSTRACT

The subject invention provides a potentially economically viable process for the destruction of small to large quantities of sulfur and nitrogen mustards and lewisite, their homologous/analogues, and similar chemical warfare agents at ambient conditions without producing any toxic by-products. The process uses the superoxide ion that is either electrochemically generated by the reduction of oxygen in ionic liquids or chemically by dissolving Group 1 (alkali metals) or Group 2 (alkaline earth metals) superoxides, e.g. potassium superoxide, in ionic liquids.

11 Claims, 1 Drawing Sheet

(A) GC chromatogram for SM before reaction (B) Mass spectrum of peak in A (C) GC chromatogram for SM after reaction.

(56) References Cited

OTHER PUBLICATIONS

Petkovic et al. "Ionic liquids: a pathway to environmental acceptability" Chem. Soc. Rev. 2011, 40, 1383-1403.*

"Ionic Liquids". http://www.organic-chemistry.org/topics/ionic-liquids.shtm. Apr. 23, 2013, 1-6.*

Yu et al. Heat capacities and electrical conductivities of 1-n-butyl-3-methylimidazolium-based ionic liquids. Thermochimica Acta 482 (2009) 42-48.*

Alnashef, Inas Muen "Electrochemistry of Superoxide Ion in Room Temperature Ionic Liquids and Its Applications to Green Engineering", UMI Microform 3142749, 2004, 151 pp.

* cited by examiner

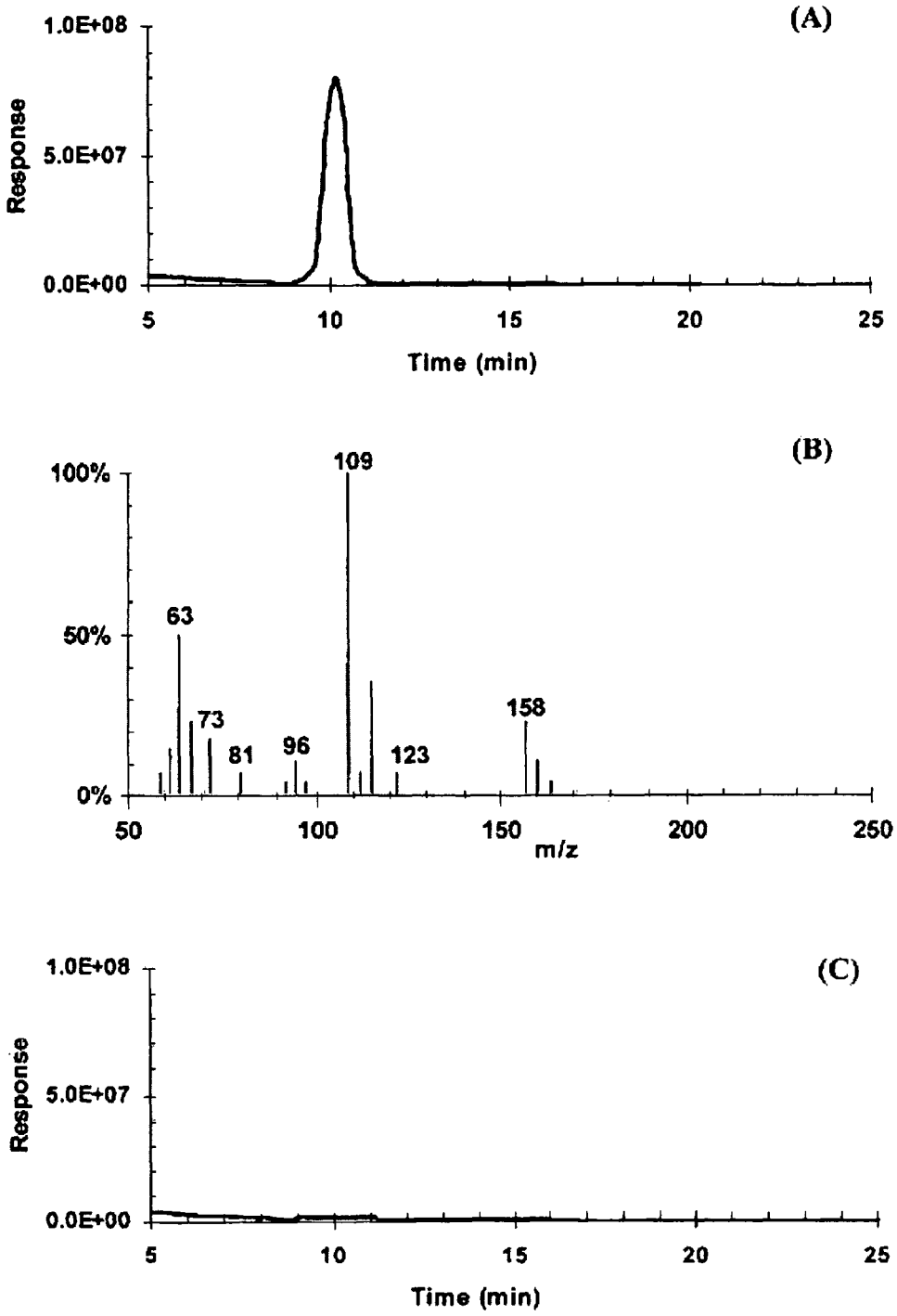
(A) GC chromatogram for SM before reaction (B) Mass spectrum of peak in A (C) GC chromatogram for SM after reaction.

PROCESS FOR THE DESTRUCTION OF SULFUR AND NITROGEN MUSTARDS AND THEIR HOMOLOGOUS/ANALOGOUS AT AMBIENT CONDITIONS

This application claims priority from U.S. Provisional Application No. 60/929,609, filed 5 Jul. 2007, the entire contents of that application is hereby incorporated by reference.

BACKGROUND OF THE INVENTION

1. Field of the Invention

This invention relates to a process for the destruction of a variety of toxic agents including sulfur and nitrogen mustard gas and Lewisite.

2. Background of the Related Art

In recent years with the global emphasis on the reduction of the huge stockpile of chemical warfare agents, the art has been confronted with the problem of safely destroying and disposing of a variety of obsolescent chemical warfare agents, e.g., mustard gas and Lewisite. Large quantities of chemical warfare agents, in various forms, are contained in a wide spectrum of munitions ranging from tactical ordnance to ballistic missiles, while equally large quantities are found in storage vessels with capacities ranging from a few grams to several tonnes. The problem of treatment and disposal is, therefore, severely complicated, not only by the extreme toxicity of infinitesimal quantities of these agents, but also by the need to simplify their recovery and to minimize the number of transfer and handling steps.

The Chemical Weapons Convention was adopted by the Conference on Disarmament in Geneva on Sep. 3, 1992, entered into force on Apr. 29, 1997, and calls for a prohibition of the development, production, stockpiling and use of chemical weapons and for their destruction under universally applied international control. Eliminating the hazard of chemical warfare agents is desirable both in storage sites and on the battlefield. The United States ratified the convention in 1997.

In August 2006 the United States of America announced that it destroyed half of all chemical weapons in its stockpile. That includes bombs, rockets, mortars, projectiles, land mines and spray tanks filled with nerve agents (including sarin and VX), plus blister agents (including mustard gas). The total destroyed to date represents 39 percent of the U.S. stockpile by weight.

To accomplish the destruction of half of the national stockpile, the Chemical Materials Agency had to overcome permitting delays and facility work stoppages, it said. In particular, the agency stated, "delays resulted from the challenges associated with obtaining, modifying and/or closing environmental permits." There were also unexpected facility work stoppages to evaluate and correct problems.

In July 2006, the United States submitted a draft request to the Executive Council of the Organization for the Prohibition of Chemical Weapons that would extend the deadline for the destruction of the entire U.S. chemical weapons stockpile from April 2007 to April 2012.

Currently, all of the mustard gas that has been produced for military purposes will be destroyed by either incineration or neutralization. However, complete destruction of the entire stockpile of mustard gas may take long time. Mustard gas is now being stored in military depots and storage facilities.

Sulfur mustard (SM), chemically known as 1,1'-thiobis-(2-chloroethane) and nitrogen mustards Bis(2-chloroethyl) ethylamine (HN1), Bis(2-chloroethyl) methylamine (HN2), Tris(2-chloroethyl) amine (HN3) are highly toxic and persistent liquid vesicants. An important aspect of any containment strategy is to be able to neutralize the threat using chemical decontamination methods. Most chemical warfare agents (CWA's) can be destroyed or rendered harmless by suitable chemical treatments.

Where the technique of incineration is permitted, certain of warfare agents, including mustard gas and the nerve gases, may be totally destroyed through thermal oxidation, since the products of combustion, e.g., sulfur dioxide, may be readily contained and prevented from escaping to the atmosphere.

On the other hand, the Lewisites, [i.e., dichloro(2-chlorovinyl)arsine, bis(2-chlorovinyl)chloroarsine and tris(2-chlorovinyl)arsine], which comprises approximately 36 weight percent arsenic, upon combustion produce the highly toxic arsenic trioxide. Under conditions normally experienced in incinerator operation, it is extremely difficult to limit the release of this contaminant to the atmosphere at acceptably low rates.

Processes known in the art for destruction of pure SM and HN consist of high temperature reaction technology, which involve destruction by heating at high temperature.

The technologies are incineration, pyrolysis, plasma torch and molten metal systems. Among all these high temperature reaction technologies, incineration is a well-proven technology for the destruction of pure SM and HN and is widely used for the destruction of pure SM and HN.

The main disadvantages of incineration are that it consumes a lot of energy and it may produce toxic products.

Another known process in the art for destruction of pure SM and HN is the low temperature destruction technology based on hydrolysis of SM and HN.

The main disadvantage of the technology involving hydrolysis is that it uses many hazardous chemicals for the destruction process.

Another known process in the art for destruction of pure SM is the low temperature destruction technology based on electrochemical oxidation. In this process SM is oxidized in Ag(II)/Ag(I) electrochemical cell in acidic medium.

The main drawback of this technology based on electrochemical oxidation is that one or two of the products are toxic in nature. Another drawback of this technology based on electrochemical oxidation is that it cannot be used for bulk destruction of pure SM.

Still another drawback of this technology based on electrochemical oxidation is that the cost involved is very high.

Another known process in the art for destruction of pure SM is the low temperature destruction technology based on solvated electron system in which pure SM is reduced by solution of metallic sodium in anhydrous liquid ammonia.

The main disadvantage of the above low temperature destruction process based on solvated electron system is that it requires precise conditions for the use of highly reactive metallic sodium. Since hydrogen chloride is present in SM, HN1, HN2, and HN3 it may lead to uncontrollable exothermic (highly flammable) reaction.

Another known process in the art of destruction of mustard gas is the low temperature destruction technology based on chemical conversion using thiophilic agents.

The major drawback of the destruction process based on thiophilic agents is that this method is suitable only for pure mustard gas. Since stock piles of mustard gas contain impurities in different concentrations, the said method cannot be used for the efficient destruction of mustard gas.

One of the present standard decontaminating means of SM is a solution of DS-2, which is composed of, on a weight basis, 70% diethylenetriamine, 28% 2-methoxyethanol and 2% sodium hydroxide. DS-2 reacts rapidly with mustard gas via proton abstraction leading to dehydrochlorination of the mustard gas to form divinylsulfide. DS-2, however, is not widely applicable since it is corrosive to metals and incompatible with a number of polymers, e.g. Laxan, polyvinyl chloride, cellulose acetate, acrylic, Mylar.

Although the hydrolysis approach for the treatment of Lewisite, especially at somewhat elevated temperatures, is capable of effectively destroying virtually all of the principal Lewisite specie, known as Lewisite I, the associated species, Lewisite II and Lewisite III (previously generically-termed "the Lewisites") are considerably more resistant to hydrolysis and will survive this treatment. The secondary species, though milder vesicants than the principal analogue, are nonetheless toxic and cannot be tolerated as a component of the reaction products.

Another undesirable feature of the hydrolysis procedure is the formation of a trivalent arsenic compound, sodium arsenite which represents one of the most toxic forms of arsenic.

Moreover, since this product is extremely soluble, some considerable difficulty is encountered in achieving its secure, permanent disposal.

A second popular approach suggested in the literature involves oxidation of the Lewisite with the aid of some oxidizing agent, e.g., sodium hypochlorite (NaOCl), chlorine ($C_2$), hydrogen peroxide ($H_2O_2$) or nitric acid ($HNO_3$).

Although complete oxidation may be possible with the nitric acid, reagents, e.g., hypochlorites and peroxides were, under the conditions investigated, found to be capable of only partial oxidation.

In each instance, a final product of the reaction is a chlorovinyl arsonic acid which, though less noxious than the original Lewisite, is nevertheless highly toxic and represents a significant final disposal problem.

It should be noted that products analogous to the arsonic acid produced by the oxidation of Lewisite I are derived from similar oxidations of Lewisite II and Lewisite III and that these constitute comparable disposal problems.

United States Statutory Invention Registration H223 disclosed a method of decontaminating articles and/or structures contaminated with or expected to be contaminated with mustard gas by treating the articles and/or structures with a transition metal complex of a tetrasulfonated or tetraamino phthalocyanine catalyst which binds oxygen from the air and converts the oxygen to superoxide. The superoxide dehydrochlorinates the mustard gas to divinylsulfide. Articles and/or structures amenable to such treatment are buildings, military vehicles, artillery weapons, tents, clothes and the like. However, this method is not suitable for mustard gas stored as liquid in containers.

U.S. Pat. No. 6,569,353 disclosed a universal decontamination formulation and method for detoxifying chemical warfare agents (CWA's) and biological warfare agents (BWA's) without producing any toxic by-products, as well as, decontaminating surfaces that have come into contact with these agents. The formulation includes a sorbent material or gel, a peroxide source, a peroxide activator, and a compound containing a mixture of $KHSO_5$, $KHSO_4$ and $K_2SO_4$. The formulation is self-decontaminating and once dried can easily be wiped from the surface being decontaminated. A method for decontaminating a surface exposed to chemical or biological agents was also disclosed.

U.S. Pat. No. 7,214,836 disclosed methods and kits for decomposing organophosphorus compounds in non-aqueous media at ambient conditions. It was claimed that insecticides, pesticides, and chemical warfare agents can be quickly decomposed to non-toxic products. The method comprised combining the organophosphorus compound with a non-aqueous solution, preferably an alcohol, comprising metal ions and at least a trace amount of alkoxide ions.

U.S. Pat. No. 7,125,497 disclosed decontamination formulations for neutralization of toxic industrial chemicals, and methods of making and using same. It was claimed that these formulations are effective for neutralizing malathion, hydrogen cyanide, sodium cyanide, butyl isocyanate, carbon disulfide, phosgene gas, capsaicin in commercial pepper spray, chlorine gas, anhydrous ammonia gas; and may be effective at neutralizing hydrogen sulfide, sulfur dioxide, formaldehyde, ethylene oxide, methyl bromide, boron trichloride, fluorine, tetraethyl pyrophosphate, phosphorous trichloride, arsine, and tungsten hexafluoride.

U.S. Pat. No. 7,102,052 disclosed a method for the neutralization of some chemical agents. In this method hydrogen peroxide is vaporized and mixed with ammonia gas in a ratio between 1:1 and 1:0.0001. The peroxide and ammonia vapor mixture are conveyed to a treatment area to neutralize V-type, H-type, or G-type chemical agents, pathogens, biotoxins, spores, prions, and the like. The ammonia provides the primary deactivating agent for G-type agents with the peroxide acting as an accelerator. The peroxide acts as the primary agent for deactivating V-type and H-type agents, pathogens, biotoxins, spores, and prions. The ammonia acts as an accelerator in at least some of these peroxide deactivation reactions.

U.S. Pat. No. 7,070,773 disclosed compositions effective in decontaminating either biological pathogens or both chemical and biological pathogens. These compositions are particularly suitable for the decontamination of biological warfare agents or both chemical and biological warfare agents. The compositions comprise generally a blend of biocides, and may additionally comprise a protein and an enzyme. Further, the composition is contained in a buffered foam forming material for ease in distribution. The compositions are nontoxic, noncorrosive and nonflammable.

U.S. Pat. No. 7,037,468 disclosed an apparatus and method for using a non-thermal plasma or corona discharge generated at multiple points and distributed to decontaminate surfaces and objects contaminated with chemical or biological agents. The corona discharge can be generated using very short high voltage pulses. The pulsed corona discharge can be directed at a contaminated surface through the unbraided strands at an end of a dielectric covered conductor. Another pulsed discharge embodiment incorporates a primary coil surrounding a chamber having a void filled with a plurality of secondary coils. A silent corona discharge can be generated using a variety of different configurations of a dielectric coated electrode and a bare electrode.

WO/1998/016332 patent disclosed improved methods for the treatment of liquid chemical compounds and process systems for practicing those methods. The methods are practiced by spraying the liquid chemical compounds into a matrix bed of heat resistant materials at temperatures sufficiently high to oxidize the chemical compounds. The sprayed liquid chemical compound is preferably heated to its gaseous state prior to contacting the matrix bed. Processing steps for removing coke deposits in the matrix bed are also provided. The methods are particularly advantageous for the destruction of chemical agents and munitions.

U.S. Pat. No. 5,545,799 disclosed a sequential process for the destruction of a toxic organic chlorine-containing compound, especially a chlorine- and arsenic-containing compound e.g., a Lewisite or a mustard gas. The process includes the first step of carrying out an oxidizing reaction between the chlorine-containing compound, and an oxidizing agent, especially hydrogen peroxide, while maintaining the temperature and the pH within pre-selected ranges e.g., about 50° C. to about 90° C. and the pH starting at about 1 to about 2 during the oxidation and terminating at about 5 to about 8 to provide an oxidation product of the original toxic organic chlorine-containing compound, original toxic chlorine- and arsenic-containing compound. After completion of the oxidizing reaction, any residual oxidizing agent is preferably catalytically decomposed. Then, the oxidation product of the original toxic organic chlorine-containing compound, is decomposed at an alkaline pH, e.g., to a maximum final pH of about 11 to provide an inorganic compound, e.g., an inorganic arsenic-containing compound. Such compound can easily and safely be disposed of.

U.S. Pat. No. 6,479,723 disclosed a process for the chemical destruction of sulfur mustard by chemical conversion that comprises in the step of reacting sulfur mustard with a thiophilic agent prepared by dissolving sulfur in ethylene diamine and/or ethanol diamine.

Fortunately, a new class of compounds, ionic liquids has emerged in the last ten years that may become a key ally in meeting the twin challenges of efficient and environmentally benign chemical processing. They have the potential to revolutionize the way we think of and use solvents. The reason is, they act like good organic solvents, dissolving both polar and nonpolar species. In many cases, they have been found to perform better than commonly used solvents. In addition, ionic liquids are non-flammable and non-volatile. The wide and readily accessible range of ionic liquids with corresponding variation in physical properties offers the opportunity to design an ionic liquid solvent system optimized for a particular process.

A key feature of ionic liquids is that their physical and chemical properties can be tailored by judicious selection of cation, anion, and substituents. For example, a choice of anions such as halide ($Cl^-$, $Br^-$, $I^-$) nitrate ($NO_3^-$), acetate ($CH_3CO_2^-$), trifluoroacetate ($CF_3CO_2^-$), triflate ($CF_3SO_3^-$) and bis(trifluoromethylsulfony) imide $(CF_3SO_2)_2N^-$) can cause dramatic changes in the properties of ionic liquids. The water solubility of the ionic liquid can be controlled by the nature of the alkyl substituent on the cation. Increasing the length of the alkyl chain tends to decrease water solubility by increasing the hydrophobicity of the cation.

We were the first to show that a stable superoxide ion can be generated in ILs [AlNashef et al. Ph. D. Dissertation, 2004]. We also showed that hexachlorobenzene could be destroyed by the reaction of the superoxide ion generated in selected ILs.

From what was mentioned above, it is clear that there is a need for a viable decontamination method that is inexpensive, occurs at ambient temperature, and most importantly, benign.

BRIEF STATEMENT OF THE INVENTION

According to one aspect of the invention there is provided a potentially economically viable benign process for the destruction of small to large quantities of sulfur and nitrogen mustards and lewisite, their homologous/analogues, and similar chemical warfare agents at ambient conditions using the superoxide ion in ILs without producing any toxic by-products. The process uses the superoxide ion that is generated in solution in situ and is then available for the intended purposes of destroying small to large quantities of sulfur and nitrogen mustards, their homologous/analogues, and similar chemical warfare agents at ambient conditions. The superoxide ion can be either electrochemically generated by the reduction of oxygen in ionic liquids or chemically by dissolving Group 1 (alkali metals) or Group 2 (alkaline earth metals) superoxides, e.g. potassium superoxide, in ionic liquids.

The nature of the compositions and the ease of generating the superoxide ion in situ, make the compositions and methods particularly adapted for effective use in processes for the destruction of sulfur and nitrogen mustards, their homologous/analogues, and similar chemical warfare agents at ambient conditions.

BRIEF DESCRIPTION OF THE DRAWINGS

FIG. 1 shows chromatograms for SM, before and after reaction with the superoxide ion, and the mass spectrum of peaks in the chromatograms.

DETAILED DESCRIPTION OF THE INVENTION

Sulfur mustard (SM) and nitrogen mustard (HN1) were synthesized in our labs using methods reported in the literature [See for example S. Franke, Manual of military chemistry, *Chemistry of Chemical Warfar Agents* vol. 1, Deutscher Militarverlag, East Berlin (1967) and S. M. Somani, Chemical Warfar Agents: Toxicity at Low Levels, CRC Press, Boca Raton (2001)]. GC/MS and HPLC analysis showed that the purity of said compounds is ≥99%.

Caution: These compounds are extremely toxic therefore trained and authorized persons should be allowed for this type of work All the reactions must be performed in an efficient fuming hood and full body protection along with respiratory protection is required during the synthesis and handling of these chemicals. To avoid any accident sufficient amount of decontamination solution should be available at working place.

It was shown in the literature that a stable superoxide ion can be generated in different types of ILs by the electrochemical reduction of oxygen in ILs. [See for example AlNashef et al. Ph. D. dissertation, 2004]. The electrochemically generated superoxide ion can be used to destroy small quantities of sulfur and nitrogen mustards, their homologous/analogues, and similar chemical warfare agents at ambient conditions in ionic liquids. The aforesaid process is explained in the following paragraphs:

Cyclic voltammetry (CV) tests were performed in ILs with a stated minimum purity of 97%, which were dried overnight in a vacuum oven at 50° C. The presence of a reduction peak at −1.0 V vs. Ag/AgCl reference electrode showed that the superoxide ion is produced. The presence of the reverse peak (oxidation of the superoxide ion) indicated that the superoxide ion is stable in the studied IL for the duration of the experiment.

Electrochemistry was performed using an EG&G 263A potentiostat/galvanostat controlled by computer and data acquisition software. The electrode configuration was a glassy carbon working (BAS, 3 mm dia.) and a platinum mesh counter (Aldrich) using Ag/AgCl reference electrode (Fisher Scientific). All CV experiments were performed in a dry glove box under an argon atmosphere. The system was sparged prior to electrochemical experiments with UHP nitrogen or oxygen.

For the mustard destruction experiments a membrane electrochemical reactor was used. The cathode and anode compartments were made of Plexiglas with appropriate openings to accommodate the electrodes and to load and unload solutions. Nafion® membrane of different thickness was used as a separator between the cathode and anode compartments. Nafion® membranes were soaked in a boiling 5M NaOH solution for 2-3 h to get rid of $H^+$ and then in boiling distilled water for about 1 h. In some cases the membrane was soaked with IL for 24 h before being used. The anode and cathode compartments were made of Plexiglas. The outside frames of the reactor were made of either Plexiglas for clear visualization of the reactor contents or from metallic alloy with proper grooves to accommodate electrical heating elements. Silicon rubber gaskets were used for leak prevention. A reticulated vitreous carbon (BAS) or Pt mesh (Aldrich) was used as a working electrode. The cathode chamber containing IL (≈20 mL) was purged with argon for 20 min. The catholyte was first pre-electrolyzed at −1.6 vs. Ag/AgCl until the background current fell to ≈1 mA. Then a weighed amount of the chemical agent to be destroyed was added to the IL and the solution was stirred with a magnet stirrer for several hours. A sample from the solution was then analyzed using HPLC to be sure that the substrate is totally dissolved in the IL. Oxygen was bubbled through the solution during the electrolysis period carried out at a constant potential of −1.1 V vs Ag/AgCl. Agitation of the catholyte was achieved by using a magnetic stirrer and through bubbling of oxygen. After electrolysis, diethyl ether was used to extract the products and the remaining reactant from the IL. A sample of the extract was then analyzed with HPLC and GC/MS.

A gas sampling bag, Tedlar®, had been used for the collection of evolved gaseous products from the reactor. The gaseous products and the sample drawn from the reaction mixture were analyzed for the identification of volatile and non-volatile products monitored by GC/MS. The results were compared with authentic samples. The gaseous contents in the sampling bags were analyzed as such by GC/MS using gas tight syringe, the analysis results showed the formation of chlorine and $SO_2$ or $NO_2$, which were matched with spectral library. These gases may be readily contained and prevented from escaping to the atmosphere.

Using HPLC and GC/MS no peak was detected for mustard gases or any known degradation product. Calibration of mustard gases using authentic compounds showed that both GC and HPLC are capable of detecting mustard gas down to 100 ppm. This means that the destruction of mustard gases was ≥99.9%. Electro-spray ionization spectrometry confirmed the presence of the bicarbonate ion.

The electrochemical process was relatively slow and due to limited solubility of oxygen in ILs the concentration of the resulting superoxide ion is rather small. In addition, the power needed for this process is relatively high and with the increase of the cost of oil this may render the process uneconomical for destruction of large quantities of wastes. Fortunately, we found that the superoxide ion can be generated by dissolving Group 1 (alkali metals) or Group 2 (alkaline earth metals) superoxides, e.g. potassium superoxide, in ILs without the need to use any additional chemicals which are usually used to enhance the solubility of these metal superoxides in aprotic solvents, e.g. crown ethers. In addition, increasing the temperature to about 50° C. increases the solubility of said superoxides drastically. The presence and stability of the superoxide ion in the tested ILs were checked using UV-vis spectrophotometer. It is well known that the superoxide ion has a peak at around 250 nm. It is also known that this value of the peak changes depending on the used solvent.

ILs were screened on the basis of the stability of the superoxide ion in solution using UV-vis spectrophotometer. ILs that proved to be resistant to the superoxide ion were used for the destruction of mustards as explained below.

A weighed amount of mustard was added to about 20 g of IL. The solution was mixed vigorously. After enough time, a sample from the solution was withdrawn and analyzed using HPLC and the resulting peak was compared to the peak of the corresponding mustard in pure organic solvent, e.g. acetone. Then small weighed amounts of the metal superoxide, e.g. potassium superoxide, were added to the solution under vigorous mixing. Samples were then taken and analyzed using HPLC until no peak for the mustard compound is detected. The solution was then extracted using a proper solvent, e.g. ethyl ether, and the sample was analyzed using GC/MS. No peaks were detected for mustard gases or any known degradation products. Samples from the solution before extraction by ether were dissolved in water and analyzed using electro-spray ionization mass spectrometer. KCl and $K_2SO_4$ or $KNO_3$ salts were formed, as confirmed by electro-spray ionization mass spectrometry. Electro-spray ionization mass spectrometry confirmed also the presence of the bicarbonate anion in all cases. During the reaction, samples of the gases evolved from the reaction were collected using gas sampling bags. The samples were then analyzed using GC/MS. No gaseous products, other than water vapor, were detected.

The IL that can be used is composed of cation and anion. The cation can be any one of the following: Imidazolium, with di or tri substitution; pyrrolidinium, with di or tri substitution; pyridinium, with di or tri substitution; phosphonium; sulfonium; or ammonium. The anion can be any of the following: Phosphates or substituted phosphates; sulfates or substituted sulfates; acetates or substituted sulfates, sulfonates or substituted sulfonaets, halide [$Cl^-$, $Br^-$, $I^-$], nitrate [$NO_3^-$], acetate [$CH_3CO_2^-$], trifluoroacetate [$CF_3CO_2^-$], triflate [$CF_3SO_3^-$]. The IL can also be a mixture of any combination of the above.

EXAMPLES

Example 1A

About 0.01 g of sulfur mustard gas was added to about 10 g of 1-butyl-2,3-dimethylimidazolium bis (trifluoromethanesulfonyl) imide. The solution was stirred using a magnetic stirrer until all the added SM is dissolved. A sample of the solution was taken and dissolved in methanol and then analyzed using HPLC. Small amounts of potassium superoxide were added carefully to the solution under vigorous stirring. Samples from the solution were taken at different intervals and dissolved in methanol and then analyzed using HPLC. The height of the peak of the SM decreased as the added potassium superoxide increased. When the peak of the SMG disappeared, the solution was extracted using diethyl ether, evaporated under vacuum and then dissolved in methanol. The sample was then analyzed using GC/MS and as can be seen in FIG. 1 no peaks were detected. No peaks were detected for mustard gas or any known degradation products. Samples from the solution before extraction by ether were dissolved in water and analyzed using electro-spray ionization mass spectrometer. KCl and $K_2SO_4$ salts were formed, as confirmed by electro-spray mass spectrometry. Electro-spray ionization mass spectrometry confirmed also the presence of the bicarbonate anion. During the reaction, samples of the gases evolved from the reaction were collected using gas sampling bags, Tedlar®. The samples were then analyzed using GC/MS. No gaseous products, other than water vapor, were detected.

Example 1B

The same procedure used in Example 1A was repeated except that the superoxide ion was generated electrochemically by the electrochemical reduction of oxygen dissolved in IL using a membrane electrochemical reactor. The working, reference, and counter electrodes were reticulated carbon, Ag/AgCl, and Pt mesh, respectively.

Example 2

The same procedure used in Example 1A was repeated except that the IL used is 1-butyl-3-methylimidazolium bis (trifluoromethanesulfonyl)imide Example 3

The same procedure used in Example 1A was repeated except that the IL used is 1-ethyl-2,3-dimethylimidazolium tosylate.

Example 4

The same procedure used in Example 1A was repeated except that the IL used is triethylsulfonium bis(trifluoromethanesulfonyl)imide.

Example 5

About 0.01 g of nitrogen mustard gas (HN1) was added to about 10 g of 1-butyl-2,3-dimethylimidazolium bis(trifluoromethanesulfonyl)imide. The solution was stirred using a magnetic stirrer until all the added HN1 is dissolved. A sample of the solution was taken and dissolved in methanol and then analyzed using HPLC. Small amounts of potassium superoxide were added carefully to the solution under vigorous stirring. Samples from the solution were taken at different intervals and dissolved in methanol and then analyzed using HPLC. When the peak of the HN1 disappeared, the solution was extracted using diethyl ether, evaporated under vacuum and then dissolved in methanol. The sample was then analyzed using GC/MS. Samples from the solution before extraction by ether were dissolved in water and analyzed using electro-spray ionization mass spectrometer. KCl and $KNO_3$ salts were formed, as confirmed by electro-spray mass spectrometry. Electro-spray ionization mass spectrometry confirmed also the presence of the bicarbonate anion. During the reaction, samples of the gases evolved from the reaction were collected using gas sampling bags. No gaseous products, other than water vapor, were detected.

Example 6

The same procedure used in Example 5 was repeated except that the used IL is (2-hydroethyl)trimethyl-ammonium dimethylphosphate.

Example 7

The same procedure used in Example 5 was repeated except that the used IL is 1-ethyl-3-hydroxymethylpyridinium ethylsulfate.

While the foregoing is directed to the preferred embodiment of the present invention, other and further embodiments of the invention may be devised without departing from the basic scope thereof, and the scope thereof is determined by the claims that follow.

We claim:

1. A method for the destruction of small to large quantities of one of a chemical warfare agent and a mixture of chemical warfare agents at ambient conditions without producing any toxic by-products, the method using a superoxide ion electrochemically generated by the reduction of oxygen in ionic liquids or chemically by dissolving Group 1 (alkali metals) or Group 2 (alkaline earth metals) superoxides, in one of an ionic liquid and a mixture of ionic liquids to react with the one of a chemical warfare agent and a mixture of chemical warfare agents, the ionic liquid and the mixture of ionic liquids each composed of a cation and an anion, the cation including one of the following: imidazolium, with di or tri substitution; pyrrolidinium, with di or tri substitution; pyridinium, with di or tri substitution; phosphonium; sulfonium; or ammonium; and the anion including one of the following: phosphates or substituted phosphates; sulfates or substituted sulfates; acetates or substituted sulfates, sulfonates or substituted sulfonates, halide [$Cl^-$, $Br^-$, $I^-$], nitrate [$NO_3^-$], acetate [$CH_3CO_2^-$], trifluoroacetate [$CF_3CO_2^-$], or triflate [$CF_3SO_3^-$].

2. The method of claim 1, wherein the said chemical warfare agent is sulfur mustard gas or its homologous/analogues compounds or mixture thereof.

3. The method of claim 1, wherein the said chemical warfare agent is nitrogen mustard gas or its homologous/analogues compounds or mixture thereof.

4. The method of claim 1, wherein the said chemical warfare agent is lewisite or its homologous/analogues compounds or mixture thereof.

5. The method of claim 1 where the reduction of oxygen has a temperature in the range of 0-100° C.

6. A method for the destruction of small to large quantities of a chemical warfare agent or mixture of chemical warfare agents at ambient conditions without producing any toxic by-products, the method comprising:

a) mixing the chemical warfare agent or mixture of chemical warfare agents with an ionic liquid or a mixture of ionic liquids, the ionic liquid or the mixture of ionic liquids consisting of a cation and an anion;

the cation including one of the following:
imidazolium, with di or tri substitution;
pyrrolidinium, with di or tri substitution;
pyridinium, with di or tri substitution;
phosphonium; sulfonium; or ammonium;

the anion including one of the following:
phosphates or substituted phosphates;
sulfonates or substituted sulfonates;
a halide [$Cl^-$, $Br^-$, $I^-$];
a nitrate [$NO_3^-$];
a trifluoroacetate [$CF_3CO_2^-$];
a triflate [$CF_3SO_3^-$];

b) maintaining the mixture of step a) at ambient temperature; and c) generating, via electrochemical generation, a superoxide ion in the mixture by a reduction of oxygen in the mixture, the superoxide ion generated in situ configured to destroy the chemical warfare agents.

7. A method as stated in claim 6, wherein the superoxide ion is generated chemically by dissolving Group 1 (alkali metals) or Group 2 (alkaline earth metals) superoxides in the ionic liquids.

8. The method of claim 6, wherein the chemical warfare agent is sulfur mustard gas or its homologous/analogues compounds or mixture thereof.

9. The method of claim 6, wherein the chemical warfare agent is nitrogen mustard gas or its homologous/analogues compounds or mixture thereof.

10. The method of claim 6, wherein the chemical warfare agent is lewisite or its homologous/analogues compounds or mixture thereof.

11. The method of claim 6, wherein two or more warfare agents are present in a solution of the at least one of the ionic liquid and the mixture of ionic liquids.

* * * * *